US010867554B2

(12) United States Patent
He et al.

(10) Patent No.: US 10,867,554 B2
(45) Date of Patent: Dec. 15, 2020

(54) PIXEL CIRCUIT, COMPENSATION METHOD FOR PIXEL CIRCUIT AND DISPLAY DEVICE

(71) Applicants: Hefei Xinsheng Optoelectronics Technology Co., Ltd., Anhui (CN); BOE Technology Group Co., Ltd., Beijing (CN)

(72) Inventors: Min He, Beijing (CN); Song Meng, Beijing (CN); Fei Yang, Beijing (CN); Chun Cao, Beijing (CN); Xiaolong Wei, Beijing (CN)

(73) Assignees: Hefei Xinsheng Optoelectronics Technology Co., Ltd., Hefei (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/502,755

(22) Filed: Jul. 3, 2019

(65) Prior Publication Data

US 2020/0211458 A1 Jul. 2, 2020

(30) Foreign Application Priority Data

Dec. 26, 2018 (CN) ..... 2018 1 1599465

(51) Int. Cl.
*G09G 3/3233* (2016.01)
*G09G 3/3266* (2016.01)
*G09G 3/3275* (2016.01)

(52) U.S. Cl.
CPC ..... *G09G 3/3233* (2013.01); *G09G 3/3266* (2013.01); *G09G 3/3275* (2013.01); (Continued)

(58) Field of Classification Search
CPC ... G09G 3/3233; G09G 3/3266; G09G 3/3275
(Continued)

(56) References Cited

U.S. PATENT DOCUMENTS 7,128,270 B2 * 10/2006 Silverbrook ..... G06F 3/03545 235/472.01
2007/0024543 A1 * 2/2007 Chung ..... G09G 3/3291 345/76

(Continued)

FOREIGN PATENT DOCUMENTS

CN 103839520 A 6/2014
CN 106504706 A 3/2017

(Continued)

OTHER PUBLICATIONS

First Office Action and English language translation, CN Application No. 201811599465.8, dated Dec. 25, 2019, 16 pp.

*Primary Examiner* — Prabodh M Dharia
(74) *Attorney, Agent, or Firm* — Myers Bigel, P.A.

(57) ABSTRACT

The present disclosure relates to a pixel circuit, a compensation method and a display device. The pixel circuit includes a first switching circuit for supplying a data voltage to a first node in response to a first scan signal being valid, a second switching circuit for conductively connecting a sensing signal line with a second node in response to a second scan signal being valid, a reset circuit for supplying a reset voltage to the sensing signal line in response to a reset control signal being valid, a light-emitting element, and a driving transistor for enabling, when the light-emitting element emits light, the sensing signal line to be charged in response to the second scan signal being valid and the reset control signal being invalid, the voltage of the sensing signal line is sensed after it was charged so as to compensate the data voltage.

19 Claims, 4 Drawing Sheets

(52) U.S. Cl.
CPC ..... *G09G 2300/0809* (2013.01); *G09G 2310/0202* (2013.01); *G09G 2320/045* (2013.01); *G09G 2330/028* (2013.01)

(58) Field of Classification Search
USPC .... 345/76, 92, 205, 212, 214, 215, 690, 691
See application file for complete search history.

(56) References Cited

U.S. PATENT DOCUMENTS

2010/0194740 A1* 8/2010 Miyazawa ..... G09G 3/3291 345/214
2011/0109660 A1* 5/2011 Kim ..... G09G 3/3233 345/690
2011/0285691 A1* 11/2011 Takasugi ..... G09G 3/3233 345/212
2012/0154460 A1* 6/2012 Segawa ..... G09G 3/3233 345/690
2013/0127924 A1* 5/2013 Lee ..... G09G 3/32 345/690
2015/0009111 A1* 1/2015 Yamauchi ..... G09G 3/3688 345/92
2015/0161940 A1* 6/2015 Woo ..... G09G 3/003 345/58
2016/0042684 A1* 2/2016 Kim ..... G09G 3/3266 345/212
2016/0086543 A1* 3/2016 Morita ..... G09G 3/3233 345/205
2016/0117984 A1* 4/2016 Yumoto ..... G09G 3/3233 345/691
2016/0247449 A1 8/2016 Yin et al.
2017/0249899 A1 8/2017 Xiang et al.
2017/0249900 A1 8/2017 Xiang et al.
2017/0249904 A1 8/2017 Li et al.
2017/0287403 A1 10/2017 Xiang et al.
2018/0330663 A1* 11/2018 Yang ..... G09G 3/3266
2019/0139492 A1* 5/2019 Chen ..... G09G 3/3266
2019/0164492 A1* 5/2019 Oh ..... G09G 3/3233
2019/0385568 A1 12/2019 Song et al.

FOREIGN PATENT DOCUMENTS

CN 106531085 A 3/2017
CN 106652907 A 5/2017
CN 106847175 A 6/2017

* cited by examiner

PIXEL CIRCUIT, COMPENSATION METHOD FOR PIXEL CIRCUIT AND DISPLAY DEVICE

RELATED APPLICATION

The present application claims the benefit of Chinese Patent Application No. 201811599465.8, filed on Dec. 26, 2018, the entire disclosure of which is incorporated herein by reference.

FIELD

The present disclosure relates to the technical field of display, and particularly to a pixel circuit, a compensation method for the pixel circuit and a display device.

BACKGROUND

Electroluminescent diodes such as Organic Light-emitting Diodes (OLEDs) have advantages such as self-luminescence and low energy consumption, and are one of hotspots in the research field of the application of electroluminescent display panels. An OLED display product controls its illumination for display by controlling the amount of current flowing through the OLEDs. Due to easy-aging characteristics of thin film transistors (TFTs) and OLEDs themselves in a structure of an OLED display product, material properties of OLED devices gradually deteriorate during a long-term display process, which causes the brightness of pixels to decay constantly. Moreover, since sub-pixels of different colors use different OLED luminescent materials, the decay speed of the brightness of the sub-pixels of different colors may also be inconsistent. This causes the white balance of an organic light-emitting display to drift. To this end, an approach of performing aging treatment before the OLED product leaves the factory is employed in a related art. However, this approach will reduce the lifetime of OLED devices, and will increase production time and affect production efficiency of the production line.

In view of this, how to perform OLED aging compensation to avoid brightness decay during a display process is an urgent problem to be solved by those skilled in the art.

SUMMARY

In a first aspect, an embodiment of the present disclosure provides a pixel circuit. The pixel circuit comprises a first switching circuit, a second switching circuit, a reset circuit, a light-emitting element, a tank circuit and a driving transistor. The first switching circuit is configured to supply a data voltage on a data input to a first node in response to a first scan signal on a first scan signal terminal being valid. The second switching circuit is configured to conductively connect a sensing signal line with a second node in response to a second scan signal on a second scan signal terminal being valid. The reset circuit is configured to supply a reset voltage on a reset signal terminal to the sensing signal line in response to a reset control signal on a reset control terminal being valid. The light-emitting element comprises a first terminal connected to the second node and a second terminal connected to a first voltage terminal. A first terminal of the tank circuit is connected to the first node, and a second terminal of the tank circuit is connected to the second node. A gate of the driving transistor is connected to the first node, a first electrode of the driving transistor is connected to the second node, a second electrode of the driving transistor is connected to a second voltage terminal, and the driving transistor is configured to drive the light-emitting element to emit light. The driving transistor is further configured to, when the light-emitting element emits light, enable the sensing signal line to be charged with a second voltage on the second voltage terminal in response to the second scan signal being valid and the reset control signal being invalid. After the sensing signal line was charged, the voltage of the sensing signal line is sensed for compensating the data voltage.

Optionally, the first switching circuit comprises a first switching transistor. A gate of the first switching transistor is connected to the first scan signal terminal, a first electrode of the first switching transistor is connected to a data signal terminal, and a second electrode of the first switching transistor is connected to the gate of the driving transistor.

Optionally, the second switching circuit comprises a second switching transistor. A gate of the second switching transistor is connected to the second scan signal terminal, a first electrode of the second switching transistor is connected to an anode of the light-emitting element, and a second electrode of the second switching transistor is connected to the sensing signal line.

Optionally, the reset circuit comprises a reset switch. A control terminal of the reset switch is connected to the reset control terminal, a first terminal of the reset switch is connected to the reset signal terminal, and a second terminal of the reset switch is connected to the sensing signal line.

Optionally, the reset control terminal is connected to a driving chip. The driving chip is configured to provide the reset control signal to control whether to provide a reset voltage to the sensing signal line.

Optionally, the tank circuit is configured to utilize its stored data voltage to make the driving transistor turn on in response to the first scan signal being invalid and the reset control signal being invalid during a voltage sensing phase.

In a second aspect, an embodiment of the present disclosure provides a compensation method for a pixel circuit. The pixel circuit is the pixel circuit according to the first aspect. The compensation method comprises: in a data writing phase, inputting the data voltage to the gate of the driving transistor and inputting the reset voltage to the second node by making the first scan signal, the second scan signal and the reset control signal be valid; in a charging phase, charging the second node via a second voltage on the second voltage terminal until the light-emitting element emits light, by making the first scan signal remain valid and the second scan signal become invalid; in a voltage sensing phase, charging the sensing signal line by making the first scan signal become invalid and controlling the second scan signal and the reset control signal accordingly, and sensing the voltage of the sensing signal line after it was charged; and in a compensation phase, and compensating the data voltage supplied to the data line based on the sensed voltage.

Optionally, the voltage sensing phase comprises: a reset phase, a light-emitting phase and a sensing phase which are sequentially arranged. In the reset phase, the reset voltage is inputted to the second node so as to reset the second node, by making the first scan signal become invalid, the second scan signal become valid and the reset control signal become valid. In the light-emitting phase, by making the second scan signal become invalid, the driving transistor is turned on with the voltage stored in the tank circuit so as to charge the second node with the second voltage until the light-emitting element emits light. In the sensing phase, the sensing signal line is charged by making the second scan signal become valid and the reset control signal being invalid.

Optionally, the first switching circuit further comprises a first switching transistor. A gate of the first switching transistor is connected to the first scan signal terminal, a first electrode of the first switching transistor is connected to the data signal terminal, and a second electrode of the first switching transistor is connected to the gate of the driving transistor. The data writing phase comprises: applying a first level signal on the first scan signal terminal to control the first switching transistor to turn on, and applying the data signal on the data signal terminal so as to input the data signal to the gate of the driving transistor.

Optionally, the second switching circuit further comprises a second switching transistor. A gate of the second switching transistor is connected to the second scan signal terminal, a first electrode of the second switching transistor is connected to the second node, and a second electrode of the second switching transistor is connected to the sensing signal line. The data writing phase comprises: applying a first level signal on the second scan signal terminal to control the second switching transistor to turn on, and applying a reset voltage on the sensing signal line so as to input the reset voltage to the second node.

Optionally, the data writing phase comprises: before inputting the data signal to the gate of the driving transistor, applying the first level signal on the second scan signal terminal to control the second switching transistor to turn on, and applying the reset voltage on the sensing signal line so as to input the reset voltage to the second node.

Optionally, the data writing phase comprises: while inputting the data signal to the gate of the driving transistor, applying the first level signal on the second scan signal terminal to control the second switching transistor to turn on, and applying the reset voltage on the sensing signal line so as to input the reset voltage to the second node.

Optionally, the charging phase comprises: after inputting the reset voltage to the second node, applying a second level signal on the second scan signal terminal so as to control the second switching transistor to turn off.

Optionally, the pixel circuit further comprises an energy storage capacitor connected between the gate and the second electrode of the driving transistor. The charging phase further comprises: after inputting the reset voltage to the second node, storing a voltage between the gate and the second electrode of the driving transistor with the energy storage capacitor.

Optionally, the voltage sensing phase comprises: applying a second level signal on the first scan signal terminal to control the first switching transistor to turn off, controlling the driving transistor to turn on with a voltage stored with the energy storage capacitor so as to charge the second node until the light-emitting element emits light; applying a first level signal on the second scan signal terminal to control the second switching transistor to turn on so as to charge the sensing signal line through the second switching transistor; sensing the voltage of the sensing signal line after it was charged.

Optionally, the compensating comprises: determining a corresponding data voltage variation based on the sensed voltage, compensating a data voltage corresponding to a to-be-written data signal according to the determined data voltage variation, and supplying the compensated data voltage at the data signal terminal in a corresponding data writing phase.

According to an embodiment of the present disclosure, there is provided a display device. The display device comprises a scan driver, a data driver and a pixel array. The scan driver is configured to sequentially supply a first scan signal to a plurality of first scan lines and sequentially supply a second scan signal to a plurality of second scan lines. The data driver is configured to generate a data voltage based on input data and supply the generated data voltage to a plurality of data lines. The pixel array comprises a plurality of pixel circuits according to the first aspect arranged in an array. The data driver is further configured to supply a reset control signal to the reset control line, obtain a sensed voltage of the sensing signal line after it is charged, and compensate a data voltage supplied to the data line based on the sensed voltage.

BRIEF DESCRIPTION OF THE DRAWINGS

The above and other aspects of the present disclosure will now be described in more detail with reference to figures which illustrate embodiments of the present disclosure.

DETAILED DESCRIPTION

According to an embodiment of the present disclosure, a compensation solution directed at OLED aging is proposed. A corresponding voltage variation under different degrees of aging may be found by looking up a table, according to a sensed voltage difference before and after aging of an OLED in combination with an OLED aging model established based on a current-voltage (I-V) curve. Compensation for the OLED aging may be implemented by feeding back the voltage variation in data written during a display process.

According to solutions of embodiments of the present disclosure, compensation for aging may be performed for a pixel circuit during a display process to avoid the brightness decay occurring during the display process.

Figure 1:
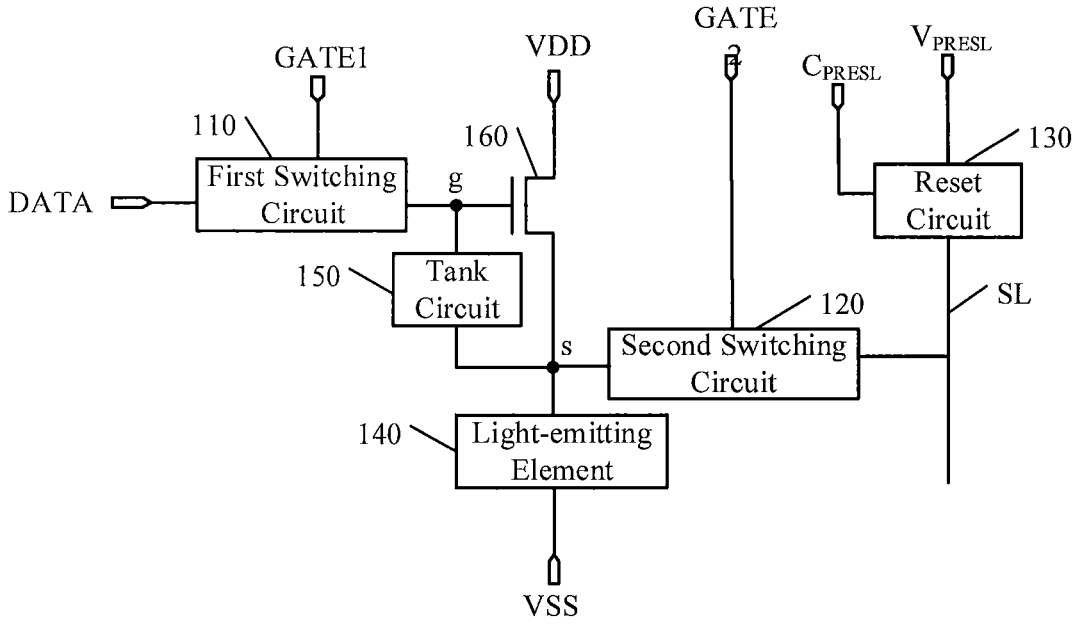
FIG. 1 is a schematic structural diagram of a pixel circuit according to an embodiment of the present disclosure.

FIG. 1 shows a schematic circuit diagram of a pixel circuit according to an embodiment of the present disclosure. As shown in FIG. 1, the pixel circuit includes a first switching circuit 110, a second switching circuit 120, a reset circuit 130, a light-emitting element 140, a tank circuit 150, and a driving transistor 160.

The first switching circuit 110 is connected to a first scan signal terminal GATE1, a data signal terminal DATA and a first node g, and is configured to supply a data signal on the data signal terminal DATA to the first node in response to a first scan signal on the first scan signal terminal GATE1 being valid.

The second switching circuit 120 is connected to a second scan signal terminal GATE2, a second node s and a sensing signal line SL, and is configured to conductively connect the sensing signal line SL with the second node in response to a second scan signal on the second scan signal terminal GATE2 being valid.

The reset circuit 130 is connected to a reset control terminal $C_{PRESL}$, a reset signal terminal $V_{PRESL}$, and the sensing signal line SL, and is configured to supply a reset voltage on the reset signal terminal to the sensing signal line SL in response to a reset control signal on the reset control terminal being valid.

A first terminal of the light-emitting element 140 is connected to the second node, and a second terminal of the light-emitting element 140 is connected to a first voltage terminal VSS. In some embodiments, the second terminal of the light-emitting element 140 may be grounded.

A tank circuit 150 is connected between the first node and the second node. The tank circuit 150 is used to store a data voltage that controls a drive current for the light-emitting element 140.

A gate of the driving transistor 160 is connected to the first node, a first electrode of the driving transistor 160 is connected to a second voltage terminal VDD, a second electrode of the driving transistor 160 is connected to the second node, and is configured to drive the light-emitting element 140 to emit light. The driving transistor supplies a current corresponding to a data voltage input on the gate to the light-emitting element 140 to drive it to emit light. The driving transistor 160 is further configured to, when the light-emitting element 140 emits light, enable the sensing signal line to be charged with a second voltage on the second voltage terminal in response to the second scan signal being valid and the reset control signal being invalid. The voltage of the charged sensing signal line is sensed and used for compensation for the data voltage.

Figure 2:
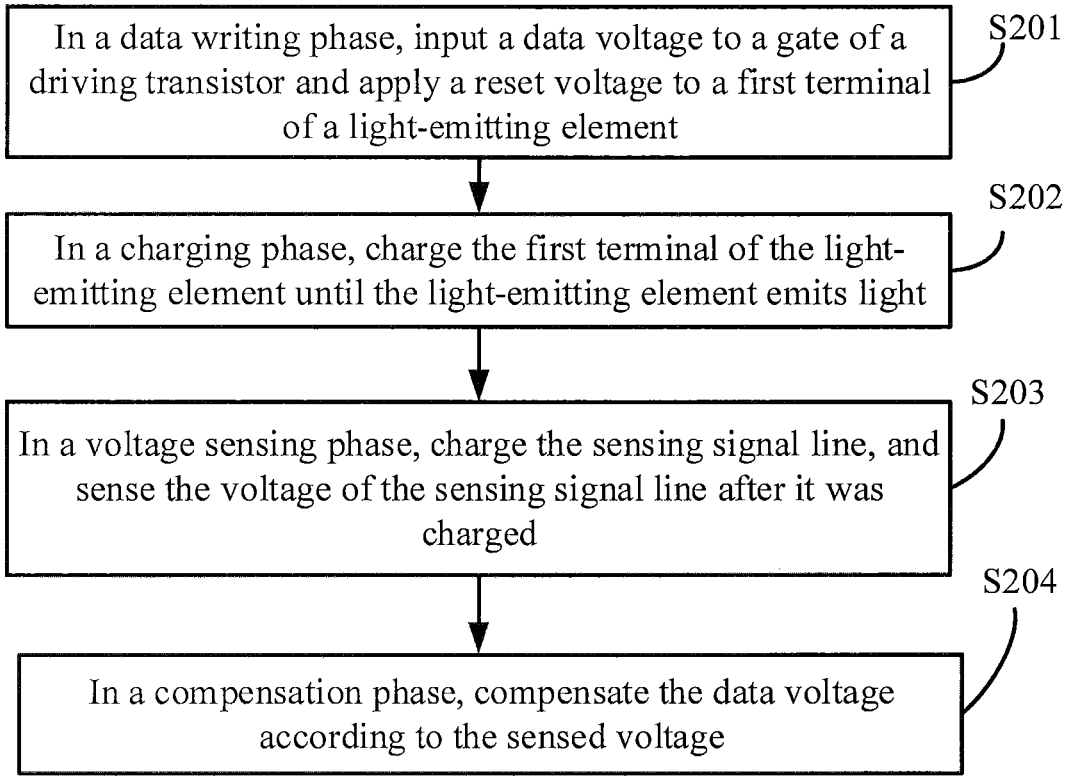
FIG. 2 is a schematic diagram of a compensation method for a pixel circuit according to an embodiment of the present disclosure.

FIG. 2 illustrates a compensation method for a pixel circuit according to an embodiment of the present disclosure. The pixel circuit includes a light-emitting element and a driving transistor that drives the light-emitting element to emit light with a driving current. A first electrode of the driving transistor is connected to a second voltage terminal, and a second electrode of the driving transistor is connected to a first terminal of the light-emitting element. A second terminal of the light-emitting element is connected to the first voltage terminal. The compensation method shown in FIG. 2 includes the following steps.

S201: a data writing phase comprises: inputting a data signal of a data signal terminal at a gate of the driving transistor in response to a first scan signal on a first scan signal terminal being valid, and applying a reset voltage $V_{PRESL}$ to the first terminal of the light-emitting element to make it reset in response to both a second scan signal on a second scan signal terminal and a reset control signal on a reset control terminal being valid. At this time, the gate voltage of the driving transistor is $V_{DATA}$, and the source voltage of the driving transistor is $V_{PRESL}$. The reset voltage $V_{PRESL}$ is set such that $V_{gs}=V_{DATA}-V_{PRESL}$ is larger than a threshold voltage $V_{th}$ of the driving transistor, and thus the driving transistor is turned on.

S202: a charging phase comprises: in response to the second scan signal becoming invalid, charging the first terminal (in other words, an equivalent capacitance $C_{OLED}$ of the light-emitting element OLED) of the light-emitting element with a first voltage applied on the first electrode of the driving transistor to raise the voltage thereof up to a turn on voltage of the light-emitting element (namely, a minimum voltage for initiating electro-optic response, also called a threshold voltage) to light the light-emitting element, namely, drive the light-emitting element to emit light.

S203: a voltage sensing phase comprises: when the light-emitting element emits light, charging the sensing signal line in response to the first scan signal becoming invalid and by correspondingly controlling the second scan signal and the reset control signal. Optionally, when both the first scan signal and the second scan signal become invalid, the driving transistor is kept ON with a data voltage stored with the tank circuit. In response to the second scan signal becoming valid and the reset control signal being invalid, the sensing signal line (in other words, a parasitic capacitance of the sensing signal line) is charged with a second voltage on the second voltage terminal, and the voltage of the sensing signal line is sensed after it was charged. The sensed voltage corresponds to a voltage on the first terminal of the light-emitting element in a light-emitting state.

S204: a compensation phase comprises: compensating the data voltage supplied to the data line according to the sensed voltage. In some embodiments, a corresponding data voltage variation may be determined according to the sensed voltage, and compensation may be performed for the to-be-written data signal according to the determined data voltage variation to provide a compensated data signal in a corresponding data writing phase. Optionally, the sensed voltage and the degree of aging of the light-emitting element are used together to determine a data voltage variation ΔV. The data voltage variation ΔV is used to adjust the data voltage of the corresponding original data signal. The adjusted data voltage is supplied to the pixel circuit on the data signal terminal in the corresponding data writing phase to achieve compensation.

According to the compensation method for the pixel circuit provided by the embodiment of the present disclosure, the voltage of the light-emitting element may be sensed during a display process (namely, when the light-emitting element is in a light-emitting state). In this way, the aging condition of the light-emitting element may be determined according to the sensed voltage of the light-emitting element, so that the aging compensation may be performed for the light-emitting element by using the sensed voltage of the light-emitting element during the display process. This avoids the brightness decay that would occur during the display process, thus improving a displaying effect of products, and improving a user experience.

Figure 3:
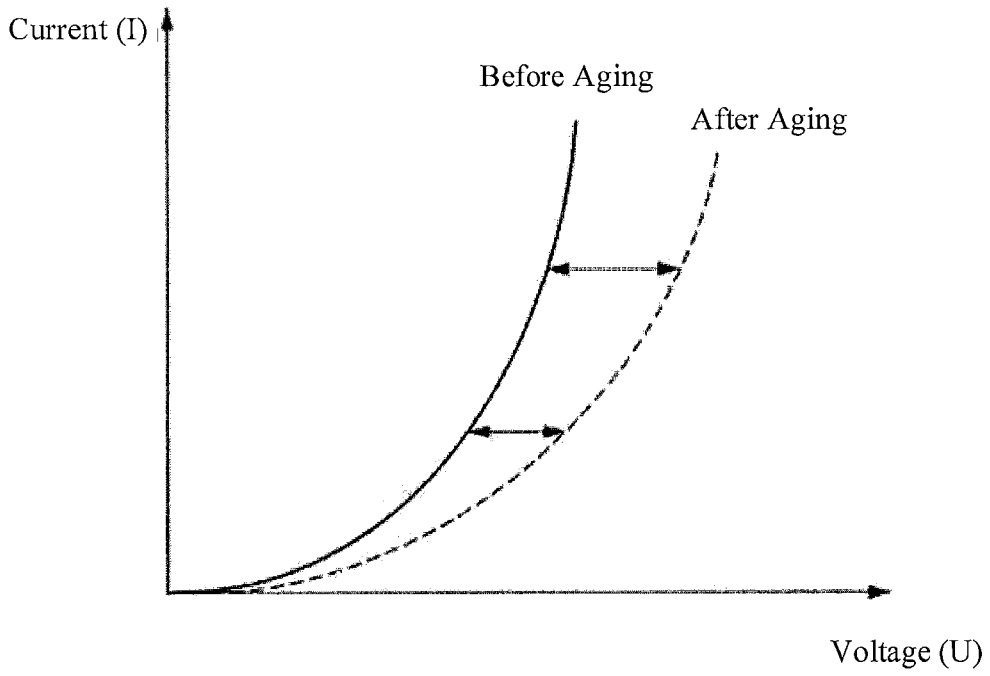
FIG. 3 is a schematic diagram of an I-V relationship curve according to an embodiment of the present disclosure.

In the compensation method for the pixel circuit provided by the embodiment of the present disclosure, the aging characteristics of the light-emitting element, such as an OLED, during the display process may be experimentally measured in advance. For example, a current (I)-voltage (V) relationship curve illustrating OLED variations with time as shown in FIG. 3 may be obtained through a test utilizing a Lifetime Cell (LTC). The I-V relationship curve before aging is depicted by a solid line, and the I-V relationship curve after aging is depicted by a dashed line. As shown in FIG. 3, as the OLED ages gradually, in order to achieve the same brightness, the voltage corresponding to the same current gradually increases. According to an embodiment of the present disclosure, in the compensation phase and after the voltage of the light-emitting element is sensed, a corresponding current value may be found on the I-V relationship curve before aging according to the sensed voltage. A desired voltage value may be found on the I-V relationship curve after aging based on this current value. A voltage difference before and after aging of the light-emitting element that corresponds to the current value may thereby be obtained. In some embodiments, an OLED aging model may be built based on the obtained I-V relationship curves, for example, a voltage lookup table may be built. Therefore, a corresponding voltage variation ΔV may be found from the lookup table according to the voltage difference before and after aging of the light-emitting element, and the ΔV may be written into the data voltage, that is, fed back to the data written during the display process, thereby realizing compensation for the voltage of the light-emitting element of the pixel circuit.

In some embodiments, sensing and compensation of the voltage of light-emitting elements may be performed for each of sub-pixels in the display panel.

Figure 4:
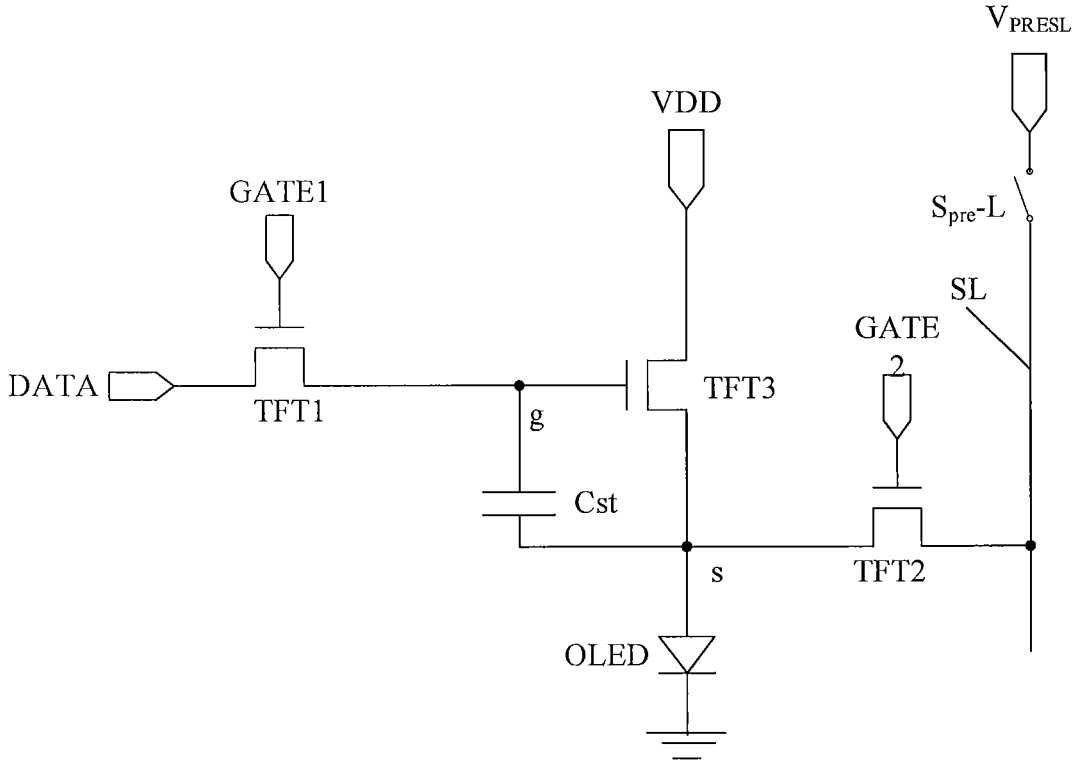
FIG. 4 is a schematic circuit diagram of a pixel circuit according to an embodiment of the present application.

FIG. 4 shows a schematic circuit diagram of a pixel circuit according to an embodiment of the present disclosure. As shown in FIG. 4, a first switching circuit includes a first switching transistor TFT1, a second switching circuit includes a second switching transistor TFT2, a reset circuit includes a reset switch $S_{pre}$_L, a driving transistor TFT3, a tank circuit includes an energy storage capacitor $C_{st}$, and a light-emitting element includes a light-emitting diode OLED.

A gate of the first switching transistor TFT1 is connected to a first scan signal terminal GATE1, a first electrode of the first switching transistor TFT1 is connected to a data signal terminal DATA, and a second electrode of the first switching transistor TFT1 is connected to a first node. A gate of the second switching transistor TFT2 is connected to a second scan signal terminal GATE2, a first electrode of the second switching transistor TFT2 is connected to a second node, and a second electrode of the second switching transistor TFT2 is connected to a sensing signal line SL. A first terminal of the reset switch $S_{pre}$_L is connected to a reset signal terminal, and a second terminal of the reset switch $S_{pre}$_L is connected to the sensing signal line SL. A gate of the driving transistor TFT3 is connected to the first node, a first electrode of the driving transistor TFT3 is connected to a first voltage terminal VDD, and a second electrode of the driving transistor TFT3 is connected to the second node. A first terminal of the energy storage capacitor $C_{st}$ is connected to the first node, and a second terminal of the energy storage capacitor $C_{st}$ is connected to the second node. A first terminal of the organic light-emitting diode OLED is connected to the second node, and a second terminal of the OLED is grounded.

To simplify the description, a first level is used to represent a valid level and a second level is used to represent an invalid level hereinafter.

According to an embodiment of the present disclosure, in the data writing phase, the first scan signal terminal GATE1 is applied with a first level signal so as to control the first switching transistor TFT1 to turn on, and the data signal terminal DATA is applied with the data signal so that the data signal is input to the gate of the driving transistor TFT3. The reset switch $S_{pre}$_L is controlled to close to apply a reset voltage on the sensing signal line SL. The second scan signal terminal GATE2 is applied with the first level signal so as to control the second switching transistor TFT2 to turn on, thereby supplying the reset voltage $V_{PRESL}$ applied on the sensing signal line SL to the second node (point s), namely, the anode of the organic light-emitting diode OLED, to reset the anode of the organic light-emitting diode OLED.

Optionally, resetting the anode of the organic light-emitting diode OLED may include: applying the first level signal on the first scan signal terminal GATE1 to control the first switching transistor TFT1 to turn on, while controlling the second switching transistor TFT2 to turn on.

Optionally, in the data writing phase, after the reset voltage $V_{PRESL}$ is input to the anode of the organic light-emitting diode OLED, the first scan signal terminal GATE1 may be applied with the first level signal so as to control the first switching transistor TFT1 to turn on, and the data signal terminal DATA may be applied with the data signal so that the data signal is input to the gate of the driving transistor TFT3.

In the charging phase, the second scan signal terminal GATE2 is applied with a second level signal so as to control the second switching transistor TFT2 to turn off. Since Vgs is greater than a threshold voltage of the driving transistor TFT3, the driving transistor TFT3 is turned on to charge the anode of the organic light-emitting diode OLED.

In the voltage sensing phase, the voltage of the anode of the organic light-emitting diode OLED may be sensed. In some embodiments, the voltage sensing phase may include a reset phase, a light-emitting phase and a sensing phase.

In the reset phase, the first scan signal terminal GATE1 is applied with the second level signal so as to control the first switching transistor TFT1 to turn off. The second scan signal terminal GATE2 is applied with the first level signal so as to control the second switching transistor TFT2 to turn on to supply the reset voltage $V_{PRESL}$ applied on the sensing signal line SL to the second node (point s), to reset the anode of the organic light-emitting diode OLED. After the reset voltage $V_{PRESL}$ is input to the anode of the organic light-emitting diode OLED, the voltage between the gate and the first electrode of the driving transistor TFT3 is stored with the energy storage capacitor $C_{st}$.

In the light-emitting phase, the driving transistor TFT3 is turned on under control of the voltage stored with the energy storage capacitor $C_{st}$, and then the anode of the organic light-emitting transistor OLED is charged until the organic light-emitting diode OLED emits light.

In the sensing phase, the second scan signal terminal GATE2 is first applied with the first level signal so that the second switching transistor TFT2 is controlled to turn on to charge the sensing signal line SL through the second switching transistor TFT2, and then the voltage of the sensing signal line SL is sensed after SL was charged. The sensed voltage is the voltage of the anode of the organic light-emitting diode OLED in the light-emitting state.

Optionally, the reset circuit (e.g., the reset switch $S_{pre}$_L) may be integrated into a driving chip (e.g., a data driver). Thus, the sensing signal line SL may be connected to the driving chip. The driving chip is used to control the closing and opening of the reset switch $S_{pre}$_L, and then control to supply the reset voltage $V_{PRESL}$ to the sensing signal line SL.

Exemplarily, in the data writing phase, the driving chip applies the first level signal on the reset switch $S_{pre}$_L, and controls the reset switch $S_{pre}$_L to close in order to provide the reset voltage to the sensing signal line SL. During the voltage sensing phase, the driving chip may apply the second level signal to the reset switch $S_{pre}$_L to control the reset switch $S_{pre}$_L to open, thereby enabling sensing of the voltage of the anode of the light-emitting diode via the sensing signal line SL.

It may be understood that each of sub-pixels of a display panel may be arranged to include a pixel circuit as shown in FIG. 4. Alternatively, multiple ones of the sub-pixels may be arranged to share the second switching transistor and the sensing signal line. Regardless of the manner of arrangement, the voltage of the anode of the light-emitting diode may be sensed and compensated by using a compensation method provided by the embodiment(s) of the present disclosure.

It should be noted that each of the above driving transistors and switching transistors may be a thin film transistor or a metal oxide semiconductor field effect transistor (MOSFET), and embodiments of the present disclosure are not limited thereto. In an embodiment according to the present disclosure, depending on types of the switching transistors and signal on signal terminals, the first electrode of the switching transistor may be its source and the second electrode of the switching transistor may be its drain; or, conversely, the first electrode of the switching transistor may be its drain and the second electrode of the switching transistor may be its source. The light-emitting transistor may be an OLED. In the above description, for a n-type transistor, the first level signal is a high-level signal and the second level signal is a low-level signal. For a p-type transistor, the first level signal is a low-level signal and the second level signal is a high-level signal.

In a pixel circuit shown in FIG. 4 provided by the embodiment of the present disclosure, the second electrode of the driving transistor TFT3 is connected to the power supply signal terminal VDD, so that the driving transistor TFT3 may be controlled to generate an operating current in a state where the gate of the driving transistor TFT3 controls the TFT3 to turn on.

Figure 5:
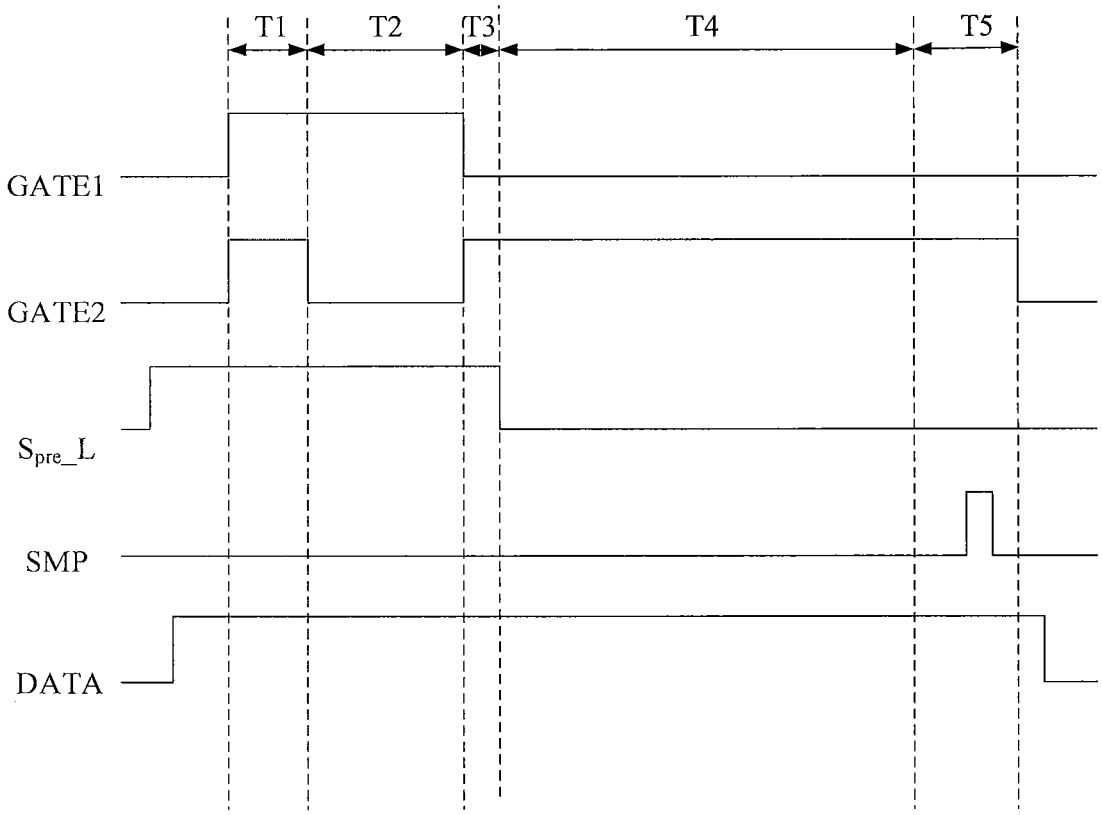
FIG. 5 is a timing diagram of a pixel circuit according to an embodiment of the present disclosure.

Next, the pixel circuit shown in FIG. 4 is taken as an example, and the compensation method for the pixel circuit provided by the embodiment of the present disclosure is illustrated with reference to a timing diagram shown in FIG. 5. Exemplarily, in the following description, it is assumed that the transistors in the circuit are all n-type transistors, and accordingly a valid potential signal may be a high-level signal and an invalid potential signal is a low-level signal.

In phase T1 (corresponding to a data writing phase), GATE1=1, GATE2=1, and $S_{pre}$_L=1. The first scan signal terminal GATE1 is applied with a high-level signal so as to control the first switching transistor TFT1 to turn on. The data signal terminal DATA is applied with a data signal so that the data signal is input to the gate of the driving transistor TFT3. The second scan signal terminal GATE2 is applied with a high-level signal so as to control the second switching transistor TFT2 to turn on. At the same time, the reset switch $S_{pre}$_L is applied with a high-level signal so as to control the reset switch $S_{pre}$_L close to apply the reset voltage $V_{PRESL}$ on the sensing signal line SL, so that the reset voltage $V_{PRESL}$ is input to the anode of the organic light-emitting diode OLED. In the T1 phase, the reset voltage $V_{PRESL}$ is input to the anode of the organic light-emitting diode OLED, that is, the voltage of the anode of the OLED is reset or initialized. The voltage $V_g$ of the first node, namely, point g, is equal to the data voltage $V_{DATA}$. The voltage $V_s$ of the second node, namely point s, is equal to the reset voltage $V_{PRESL}$. The voltage between point g and point s $V_{gs}=V_{DATA}-V_{PRESL}$.

In phase T2 (corresponding to a charging phase), GATE1=1, GATE2=0 and $S_{pre}$_L=1. The first scan signal terminal GATE1 is applied with a high-level signal so as to control the first switching transistor TFT1 to turn on. The data signal terminal DATA is applied with the data signal so that the data signal is input to the gate of the driving transistor TFT3. The second scan signal terminal GATE2 is applied with a low-level signal so as to control the second switching transistor TFT2 to turn off. The driving transistor TFT3 is turned on since Vgs is greater than its threshold voltage, so as to charge the anode of the organic light-emitting diode OLED. In the T2 phase, the driving transistor TFT3 is turned on, the second switching transistor TFT2 is turned off, and the first voltage terminal EVDD charges a parasitic capacitance $C_{OLED}$ of the organic light-emitting diode OLED through the driving transistor TFT3. Therefore, the point s is charged, the voltage at the point g does not change, and then $V_{gs}$ gradually decreases. The point s is charged until $V_S$ reaches the turn on voltage of the organic light-emitting diode OLED, so that the organic light-emitting diode OLED is lit.

In phase T3 (corresponding to a reset phase), GATE1=0, GATE2=1 and $S_{pre}$_L=1. The first scan signal terminal GATE1 is applied with a low-level signal so as to control the first switching transistor TFT1 to turn off. The second scan signal terminal GATE2 is applied with a high-level signal so as to control the second switching transistor TFT2 to turn on. At the same time, the reset switch $S_{pre}$_L is applied with a high-level signal so as to control the reset switch $S_{pre}$_L to close. The sensing signal line SL is applied with the reset voltage $V_{PRESL}$ so that the reset voltage $V_{PRESL}$ is input to the anode of the organic light-emitting diode OLED, and $V_s=V_{PRESL}$. As the voltage at the point s drops and $V_g$ drops by the same amplitude, $V_{gs}$ does not change and is stored in the energy storage capacitor Cst. In the T3 phase, the reset voltage $V_{PRESL}$ is input to the anode of the organic light-emitting diode OLED, that is, the voltage of the anode of the OLED is re-initialized.

In phase T4 (corresponding to the light-emitting phase), GATE1=0, GATE2=1 and $S_{pre}$_L=0. The first scan signal terminal GATE1 is applied with a low-level signal so as to control the first switching transistor TFT1 to turn off, the second scan signal terminal GATE2 is applied with a high-level signal so as to control the second switching transistor TFT2 to turn on. At the same time, the reset switch $S_{pre}$_L is applied with a low-level signal so as to control the reset switch $S_{pre}$_L to open. The $V_g$s stored in the energy storage capacitor Cst controls the driving transistor TFT3 to turn on, and then the first voltage terminal EVDD charges the parasitic capacitance of the sensing signal line SL through the driving transistor TFT3, that is, the point s is charged until the organic light-emitting diode OLED is lit. At this time, $V_s$ is equal to the voltage $V_{OLED}$ of the anode of the organic light-emitting diode OLED. Due to a storage function of the energy storage capacitor Cst, as the voltage at the point s rises, $V_g$ rises by the same amplitude, and $V_{gs}$ remains unchanged. Since the second switching transistor TFT2 is turned on, the (parasitic capacitance of) the sensing signal line SL is charged through the second switching transistor TFT2.

In phase T5 (corresponding to a sensing phase), GATE1=0, GATE2=1 and $S_{pre}$_L=0. Since states of control signals on respective control lines in this phase are consistent with the phase T4, the sensing signal line SL is still charged through the second switching transistor TFT2. The voltage of the sensing signal line SL after being charged, namely, the voltage $V_s$ of the point s (OLED anode), may be sensed through the sensing signal line SL. In some embodiments, a sampling signal SMP may be set at the driving chip to control sampling of Vs. As shown in FIG. 5, $V_s$ may be sampled at a falling edge of the sampling signal SMP.

It may be understood that in the phase T2, since the second switching transistor TFT2 is turned off, whether the reset switch $S_{pre}$_L is closed or opened does not affect the sensing of the voltage of the anode of the OLED. Optionally, since in the phase T3, it is still required to control the reset switch $S_{pre}$_L to close, it is optional to control the reset switch $S_{pre}$_L to close in the phase T2, thereby reducing timing complexity of the pixel circuit.

According to the compensation method provided by the embodiment of the present disclosure, the voltage of the anode of the OLED may be sensed according to a preset sensing period and voltage compensation may be performed accordingly. The preset sensing period may be set, for example, to one day, 30 days, 2 months, or half a year.

Certainly, in a practical application, a specific implementation of the preset sensing period may be designed and determined according to actual application environment, and is not limited to examples given in the foregoing embodiments.

Figure 6:
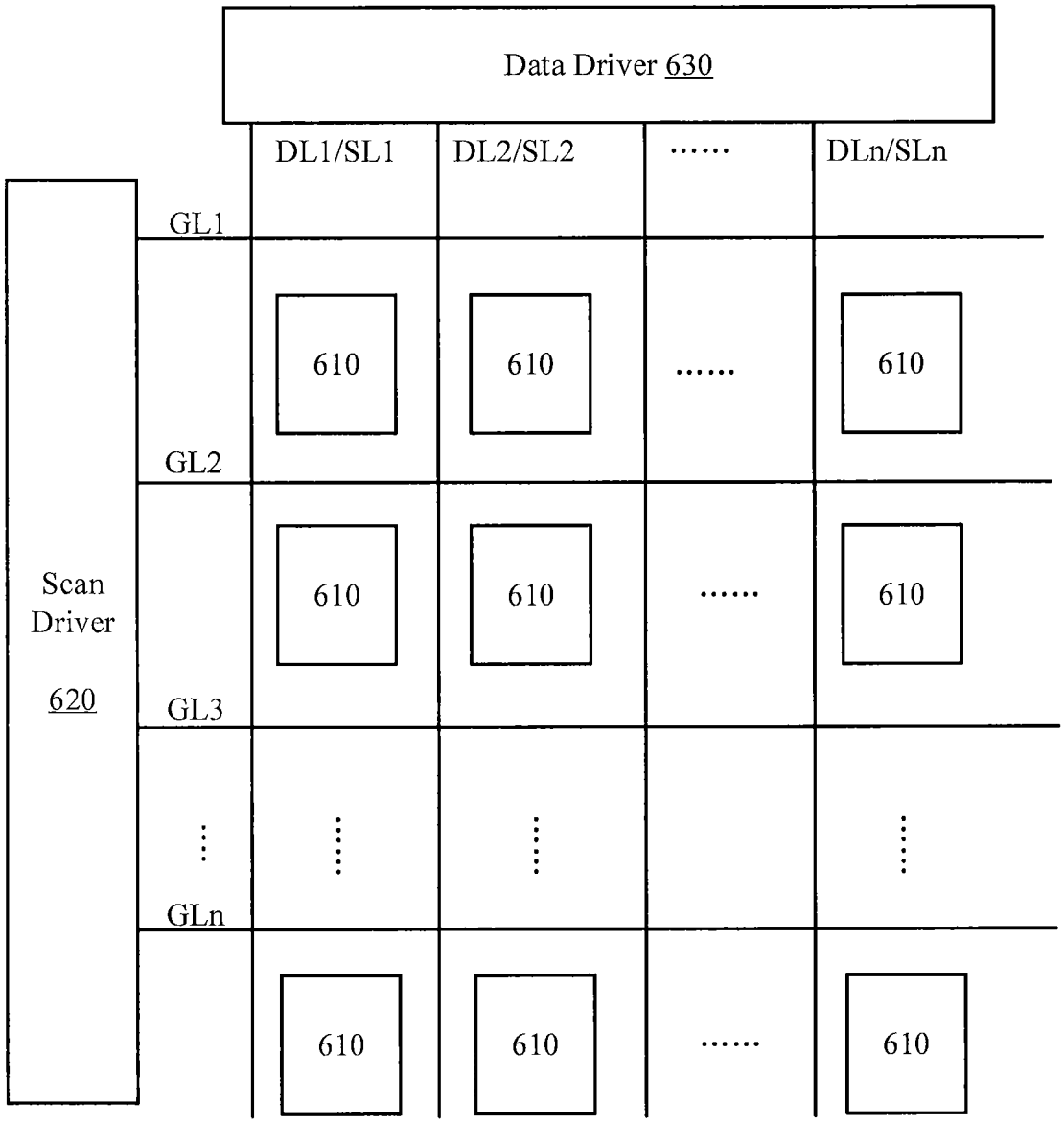
FIG. 6 is a schematic structural diagram of a display device according to an embodiment of the present disclosure.

FIG. 6 illustrates a display device according to an embodiment of the present disclosure. As shown in FIG. 6, the display device includes a plurality of pixel units 610 distributed in an array and a plurality of control lines. The control lines include scan lines, data lines, and detection signal lines. It would be noted that FIG. 6 only shows some of the pixel units 610 and control lines, and embodiments of the present disclosure are not limited thereto. Each pixel unit 610 may include any pixel circuit according to embodiments of the present disclosure, for example, the pixel circuits described above with reference to FIGS. 1-5.

As shown in FIG. 6, the display device may further include a scan driver 620 and a data driver 630.

The scan driver 620 may be connected to a plurality of control lines to provide control signals to the pixel circuit 410. The control lines may include a plurality of scan lines (GL1, GL2, . . . GLn) to provide scan signals and other associated control signals to respective pixel circuits. It may be understood that although only one scan line is shown for each pixel unit, each pixel unit may be connected to a plurality of scan lines. Accordingly, the scan driver 620 may be configured to sequentially supply a first scan signal to a plurality of first scan lines and sequentially supply a second scan signal to a plurality of second scan lines.

The data driver 630 is configured to generate a data voltage based on input data and supply the generated data voltage to the plurality of data lines. The data driver 630 may be connected to a plurality of data lines and a plurality of sensing signal lines (SL1, SL2, . . . , SLn), in order to supply the pixel data voltage data through the data lines (DL1, DL2, . . . , DLn) and other related control signals to respective pixel circuits. The data driver 630 is also configured to supply a reset control signal to a reset control line to apply a reset voltage to the pixel circuit through the sensing signal line. The data driver 630 further obtains the sensed voltage of the sensing signal line after being charged, and compensates the data voltage supplied to the data line based on the sensed voltage.

An embodiment of the present disclosure provides a display device. The display device includes a pixel circuit. Compensation may be performed for the pixel circuit by employing the above compensation method provided by embodiments of the present disclosure.

The display device provided by embodiments of the present disclosure may be a device such as a mobile phone, a computer or a television.

In summary, according to a compensation method for a pixel circuit and a display device provided by the embodiments of the present disclosure, the voltage of the anode of the light-emitting diode may be sensed during a display process. As such, the aging degree of the light-emitting diode may be determined subsequently according to the sensed voltage of the anode of the light-emitting diode, so that aging compensation may be performed for the light-emitting diode using the sensed voltage of the anode of the light-emitting diode during the display process, thereby avoiding the brightness decay that would otherwise occurs during the display process, improving the display effect of the products and enhancing the user's experience.

Those skilled in the art would appreciate that embodiments of the present application may be provided as a method, system, or computer program product. Therefore, the present application may take a form of a completely hardware embodiment, a completely software embodiment, or an embodiment integrating software and hardware. Moreover, the present application may take the form of a computer program product embodied on one or more computer-usable storage media (including but not limited to disk storage and optical storage, etc.) including computer usable program codes therein.

The present application is described with reference to flowcharts and/or block diagrams of methods, apparatus (systems), and computer program products according to embodiments of the present disclosure. It will be understood that the computer program instructions implement each flow and/or block of the flowcharts and/or block diagrams, and a combination of flows and/or blocks in the flowcharts and/or block diagrams. These computer program instructions may be provided to a processor of a general-purpose computer, special-purpose computer, embedded processor, or other programmable data processing device to produce a machine for the execution of instructions to produce, through the instructions executed by the processor of the computer or other programmable data processing devices, means for implementing functions designated in one or more flows in the flowcharts and/or one or more blocks in block diagrams.

The computer program instructions may also be stored in a computer readable memory that may guide a computer or other programmable data processing device to operate in a particular manner, such that the instructions stored in the computer readable memory produce an article of manufacture comprising an instruction device. The instruction device implements functions designated in one or more flows in the flowcharts and/or one or more blocks in block diagrams.

These computer program instructions may also be loaded into a computer or other programmable data processing device such that a series of operation steps are performed on the computer or other programmable device to produce computer-implemented processing so that the instructions executed on the computer or other programmable devices provide steps for implementing functions designated in one or more flows in the flowcharts and/or one or more blocks in block diagrams.

It is apparent to those skilled in the art that various modifications and variations may be made in the present application without departing from the spirit and scope of the present application. As such, if such modifications and variations of the present application fall within the scope of the claims of the present application and their equivalents, the present application is also intended to include these modification and variations.

The invention claimed is:

1. A pixel circuit, comprising:

a first switching circuit configured to supply a data voltage on a data input to a first node in response to a first scan signal on a first scan signal terminal being valid, wherein the first scan signal is arranged to be valid during a data writing phase and a charging phase, and to be invalid during a reset phase, a light-emitting phase and a sensing phase;

a second switching circuit configured to conductively connect a sensing signal line with a second node in response to a second scan signal on a second scan signal terminal being valid wherein the second scan signal is arranged to be valid during the data writing phase, the reset phase, the light-emitting phase and the sensing phase, and to be invalid during the charging phase;

a reset circuit configured to supply a reset voltage on a reset signal terminal to the sensing signal line in response to a reset control signal on a reset control terminal being valid, wherein the reset control signal is arranged to be valid during the data writing phase and the reset phase, and to be invalid during the light-emitting phase and the charging phase;

a light-emitting element comprising a first terminal connected to the second node and a second terminal connected to a first voltage terminal;

a tank circuit comprising a first terminal connected to the first node and a second terminal connected to the second node and configured to store the data voltage during the charging phase; and a driving transistor comprising a gate connected to the first node, a first electrode connected to the second node and a second electrode connected to a second voltage terminal, wherein the driving transistor is configured to drive the light-emitting element to emit light, wherein the second switching circuit is further configured to input the reset voltage to the second node in response to both the second scan signal and the reset control signal being valid during the reset phase; and the driving transistor is further configured to be turned on under control of the data voltage stored with the tank circuit in response to the first scan signal being invalid, and the second scan signal and the reset control signal being valid during the light-emitting phase, so as to charge the first terminal of the light-emitting element with a second voltage on the second voltage terminal until the light-emitting element is lit, and configured to, when the light-emitting element emits light, enable the sensing signal line to be charged with the second voltage in response to the first scan signal being invalid, the second scan signal being valid and the reset control signal being invalid during the sensing phase, and wherein a voltage of the sensing signal line is sensed after the sensing signal line was charged for compensating the data voltage.

2. The pixel circuit according to claim 1, wherein the first switching circuit comprises a first switching transistor, the first switching transistor comprising a gate connected to the first scan signal terminal, a first electrode connected to a data signal terminal, and a second electrode connected to the gate of the driving transistor.

3. The pixel circuit according to claim 1, wherein the second switching circuit comprises a second switching transistor, the second switching transistor comprising a gate connected to the second scan signal terminal, a first electrode connected to an anode of the light-emitting element, and a second electrode connected to the sensing signal line.

4. The pixel circuit according to claim 1, wherein the reset circuit comprises a reset switch, the reset switch comprising a control terminal connected to the reset control terminal, a first terminal connected to the reset signal terminal, and a second terminal connected to the sensing signal line.

5. The pixel circuit according to claim 1, wherein the reset control terminal is connected to a driving chip, and wherein the driving chip is configured to provide the reset control signal to control whether to provide a reset voltage to the sensing signal line.

6. The pixel circuit according to claim 1, wherein the tank circuit comprises an energy storage capacitor.

7. A compensation method for a pixel circuit, wherein the pixel circuit comprises a first switching circuit configured to supply a data voltage on a data input to a first node in response to a first scan signal on a first scan signal terminal being valid; a second switching circuit configured to conductively connect a sensing signal line with a second node in response to a second scan signal on a second scan signal terminal being valid; a reset circuit configured to supply a reset voltage on a reset signal terminal to the sensing signal line in response to a reset control signal on a reset control terminal being valid; a light-emitting element comprising a first terminal connected to the second node and a second terminal connected to a first voltage terminal; a tank circuit comprising a first terminal connected to the first node and a second terminal connected to the second node; and a driving transistor comprising a gate connected to the first node, a first electrode connected to the second node and a second electrode connected to a second voltage terminal, and configured to supply a current corresponding to the data voltage applied on the gate to the light-emitting element, the compensation method comprising:

inputting the data voltage to the gate of the driving transistor and inputting the reset voltage to the second node by making the first scan signal, the second scan signal and the reset control signal be valid in a data writing phase;

storing the data voltage with the tank circuit and charging the second node via a second voltage on the second voltage terminal until the light-emitting element emits light, by making the first scan signal remaining valid and the second scan signal become invalid in a charging phase;

charging the sensing signal line by making the first scan signal become invalid and controlling the second scan signal and the reset control signal accordingly, and sensing a voltage of the sensing signal line after the sensing signal line is charged in a voltage sensing phase; and compensating the data voltage supplied to a data line based on a sensed voltage in a compensation phase;

wherein the voltage sensing phase comprises a reset phase, a light-emitting phase and a sensing phase which are sequentially arranged, wherein in the reset phase, the reset voltage is inputted to the second node so as to re-initialize the second node, by making the second scan signal become valid and the reset control signal become valid;

wherein in the light-emitting phase, the driving transistor is turned on with the data voltage stored in the tank circuit to charge the second node with the second voltage until the light-emitting element emits light, by making the second scan signal remain valid and the reset control signal become invalid; and in the sensing phase, the sensing signal line is charged, when the light-emitting element emits light, by making the second scan signal remain valid and the reset control signal remain invalid.

8. The method according to claim 7, wherein the first switching circuit further comprises a first switching transistor, the first switching transistor comprising a gate connected to the first scan signal terminal, a first electrode connected to a data signal terminal, and a second electrode connected to the gate of the driving transistor, and wherein the data writing phase comprises:

applying a first level signal on the first scan signal terminal to control the first switching transistor to turn on, and applying a data signal on the data signal terminal to input the data signal to the gate of the driving transistor.

9. The method according to claim 8, wherein the second switching circuit further comprises a second switching transistor, the second switching transistor comprising a gate connected to the second scan signal terminal, a first electrode connected to the second node, and a second electrode connected to the sensing signal line, and wherein the data writing phase comprises:

applying a first level signal on the second scan signal terminal to control the second switching transistor to turn on; and applying a reset voltage on the sensing signal line to input the reset voltage to the second node.

10. The method according to claim 9, wherein the data writing phase comprises:

applying the first level signal on the second scan signal terminal to control the second switching transistor to turn on; and applying the reset voltage on the sensing signal line to input the reset voltage to the second node, before the data signal is inputted to the gate of the driving transistor.

11. The method according to claim 9, wherein the data writing phase comprises:

applying a first level signal on the second scan signal terminal to control the second switching transistor to turn on; and applying the reset voltage on the sensing signal line to input the reset voltage to the second node, while inputting the data signal to the gate of the driving transistor.

12. The method according to claim 9, wherein the charging phase comprises:

applying a second level signal to the second scan signal terminal to control the second switching transistor to turn off, after the reset voltage is input to the second node.

13. The method according to claim 9, wherein the tank circuit comprises an energy storage capacitor, and wherein the charging phase further comprises:

storing a voltage between the gate and the second electrode of the driving transistor with the energy storage capacitor, after the reset voltage is inputted to the second node.

14. The method according to claim 9, wherein the voltage sensing phase comprises:

applying a second level signal on the first scan signal terminal to control the first switching transistor to turn off;

controlling the driving transistor to turn on with a voltage stored with an energy storage capacitor to charge the second node until the light-emitting element emits light;

applying a first level signal on the second scan signal terminal to control the second switching transistor to turn on to charge the sensing signal line through the second switching transistor; and sensing the voltage of the sensing signal line after the sensing signal line is charged through the sensing signal line.

15. The method according to claim 7, wherein the compensating comprises:

determining a corresponding data voltage variation based on a sensed voltage;

compensating a data voltage corresponding to a to-be-written data signal according to a determined data voltage variation; and supplying a compensated data voltage at a data signal terminal in a corresponding data writing phase.

16. A display device, comprising:

a scan driver configured to sequentially supply a first scan signal to a plurality of first scan lines and sequentially supply a second scan signal to a plurality of second scan lines wherein the first scan signal is arranged to be valid during a data writing phase and a charging phase and to be invalid during a reset phase, a light-emitting phase and a sensing phase, and the second scan signal is arranged to be valid during the data writing phase, the reset phase, the light-emitting phase and the sensing phase and to be invalid during the charging phase;

a data driver configured to generate a data voltage based on input data and supply a generated data voltage to a plurality of data lines and further configured to supply a reset control signal to a reset control line, wherein the reset control signal is arranged to be valid during the data writing phase and the reset phase and to be invalid during the light-emitting phase and the charging phase;

a pixel array comprising a plurality of pixel circuits arranged in an array, each pixel circuit comprising:

a first switching circuit connected to a first scan line, a data line and a first node, and configured to supply a data voltage on the data line to the first node in response to a first scan signal on the first scan line being valid;

a second switching circuit connected to a second scan line, a second node and a sensing signal line, and configured to conductively connect the sensing signal line with the second node in response to a second scan signal on the second scan line being valid;

a reset circuit connected to a reset control line, a reset voltage terminal and the sensing signal line, and configured to supply a reset voltage at the reset voltage terminal to the sensing signal line in response to a reset control signal on the reset control line being valid;

a light-emitting element comprising a first terminal connected to the second node and a second terminal connected to a first voltage terminal;

a tank circuit comprising a first terminal connected to the first node and a second terminal connected to the second node and configured to store the data voltage during the charging phase; and a driving transistor comprising a gate connected to the first node, a first electrode connected to the second node and a second electrode connected to a second voltage terminal, wherein the driving transistor is configured to supply a current corresponding to a data voltage input on the gate to the light-emitting element, wherein the second switching circuit is further configured to input the reset voltage to the second node in response to both the second scan signal and the reset control signal being valid; and the driving transistor is further configured to be turned on under control of the data voltage stored with the tank circuit in response to the first scan signal being invalid, and the second scan signal and the reset control signal being valid during the light-emitting phase, so as to charge the first terminal of the light-emitting element with a second voltage on the second voltage terminal until the light-emitting element is lit, and configured to, when the light-emitting element emits light, enable the sensing signal line to be charged with the second voltage in response to the first scan signal being invalid, the second scan signal being valid and the reset control signal being invalid during the sensing phase, and wherein the data driver is further configured to obtain a sensed voltage of the sensing signal line after the sensing signal line charged, and compensate a data voltage supplied to the data line based on a sensed voltage.

17. The display device according to claim 16, wherein the first switching circuit comprises a first switching transistor, the first switching transistor comprising a gate connected to a first scan signal terminal, a first electrode connected to a data signal terminal, and a second electrode connected to the gate of the driving transistor.

18. The display device according to claim 16, wherein the second switching circuit comprises a second switching transistor, the second switching transistor comprising a gate connected to a second scan signal terminal, a first electrode connected to an anode of the light-emitting element, and a second electrode connected to the sensing signal line.

19. The display device according to claim 16, wherein the reset circuit comprises a reset switch comprising a control terminal connected to a reset control terminal, a first terminal connected to a reset signal terminal, and a second terminal connected to the sensing signal line.

* * * * *